US009677413B2

(12) United States Patent
Cohin et al.

(10) Patent No.: US 9,677,413 B2
(45) Date of Patent: Jun. 13, 2017

(54) INTERFACE DEVICE BETWEEN TWO TURBOMACHINE ELEMENTS

(71) Applicant: SNECMA, Paris (FR)

(72) Inventors: Arthur Cohin, La Varenne Saint-Hilaire (FR); Audrey Charrie, Melun (FR); Florent Gant, Palaiseau (FR); Aurelien Rene-Pierre Massot, Vaux le Penil (FR)

(73) Assignee: SNECMA, Paris (FR)

( * ) Notice: Subject to any disclaimer, the term of this patent is extended or adjusted under 35 U.S.C. 154(b) by 478 days.

(21) Appl. No.: 14/280,801

(22) Filed: May 19, 2014

(65) Prior Publication Data

US 2014/0348637 A1 Nov. 27, 2014

(30) Foreign Application Priority Data

May 23, 2013 (FR) ..... 13 54648

(51) Int. Cl.
*F01D 11/24* (2006.01)
*F01D 9/06* (2006.01)

(52) U.S. Cl.
CPC ..... *F01D 11/24* (2013.01); *F01D 9/065* (2013.01); *F05D 2240/62* (2013.01); *F05D 2260/96* (2013.01)

(58) Field of Classification Search
CPC ..... F01D 11/24; F01D 9/065; F05D 2240/62; F05D 2260/96
USPC ..... 415/116, 117; 60/262, 226.1, 782, 785, 60/231
See application file for complete search history.

(56) References Cited

U.S. PATENT DOCUMENTS 5,947,412 A * 9/1999 Berman ..... B64C 7/02 239/265.17
5,993,150 A 11/1999 Liotta et al.
5,996,936 A * 12/1999 Mueller ..... B64D 33/04 239/265.17
6,126,389 A 10/2000 Burdgick
7,950,218 B2 * 5/2011 Beutin ..... F01D 9/065 239/265.17
2008/0054048 A1 3/2008 Szela et al.
2008/0112798 A1 * 5/2008 Seitzer ..... F01D 11/24 415/144

FOREIGN PATENT DOCUMENTS

EP 0 919 700 A1 6/1999
EP 1 705 340 A2 9/2006

OTHER PUBLICATIONS

French Preliminary Search Report issued Jan. 30, 2014 in French Application 13 54648, filed on May 23, 2013 ( with English Translation of Categories of Cited Documents).

* cited by examiner

*Primary Examiner* — Hoang Nguyen
(74) *Attorney, Agent, or Firm* — Oblon, McClelland, Maier & Neustadt, L.L.P.

(57) ABSTRACT

An interface device between first and second turbomachine elements is provided. The interface device includes an annular air inlet structure including opposite first and second parts, designed to come into contact with the first and second turbomachine elements respectively, in which the first part is configured to be in swivel contact with the first element; and an elastic return device that can be placed around the air inlet structure and designed to come into contact with at least the first turbomachine element.

11 Claims, 3 Drawing Sheets

INTERFACE DEVICE BETWEEN TWO TURBOMACHINE ELEMENTS

TECHNICAL FIELD

This invention relates to the field of turbomachines, more particularly the field of interface or connection devices between two turbomachine elements.

The invention is applicable to all types of land-based and aeronautical turbomachines, and particularly aircraft turbomachines such as turbojets and turboprops. More preferably, the invention is applicable to a twin-spool turbofan engine.

On this type of turbojet, there may be one or several interface devices between two elements of the turbojet. For example, this is the case for the interface between an active or inactive system for adjustment of the clearance at the tip of rotor blades (the clearance between the tip of the blades and the turbine casing) for a low pressure turbine (referred to below as LPTACC—Low Pressure Turbine Active Clearance Control—for an active system or LPTCC—Low Pressure Turbine Clearance Control—for an inactive system), and a scoop located on a part forming an envelope, the outside of which defines an inner delimitation surface of a fan flowpath, this part also being called the IFD part (Inner Fan Duct).

The invention is more precisely related to an interface device between two turbomachine elements, and a turbomachine comprising such an interface device.

STATE OF PRIOR ART

With reference to FIG. 1, the figure shows a diagrammatic longitudinal half-sectional view of an example turbofan engine 10 for an aircraft. Throughout this description, the terms "forward" and "aft" should be considered relative to a forward direction of the aircraft created as the result of the turbojet thrust, this direction being diagrammatically represented by the arrow F. The terms "upstream" and "downstream" should be considered relative to a principal normal direction of gas flow within the turbojet (from upstream to downstream), opposite the forward direction F of the aircraft.

Working in order from upstream to downstream, the turbojet 10 with longitudinal axis X comprises a fan 60, a low pressure compressor 80, a high pressure compressor 40, an annular combustion chamber 12, a high pressure turbine 14 and a low pressure turbine 16. The compressors, turbines and the combustion chamber form the gas generator that is partly closed by a central casing 18 centred on the X axis, through which a core engine flow Fp of the turbojet passes.

This central case 18 prolongs a fan frame 20 in the aft direction, and the aft end of the central case 18 is prolonged by a turbine frame 32 downstream from the low pressure turbine 16.

First means 36 forming the envelope aerodynamically prolong the inner ring of the fan frame 20 in the aft direction, and are arranged around the central case 18. These means, called the Inner Fan Duct, have an outer annular surface 37 that forms the inner delimitation of an annular fan flowpath 38, through which the fan flow Fs of the turbojet passes. The surface 37 aerodynamically prolongs another surface 39 in the aft direction, that also forms the inner delimitation of the annular fan flowpath 38, this surface 39 being defined by the inner ring of the fan frame 20.

The annular space 46 left free between the central case 18 and the IFD part 36 acts as a compartment inside which equipment is placed.

Second means 41 forming an envelope are arranged concentric with and external to the above-mentioned IFD part 36, aerodynamically prolonging the outer ring of the fan frame 20 in the aft direction. These means, also called the OFD (Outer Fan Duct) have an inner annular surface 42 that forms the outer delimitation of the flowpath 38. The surface 42 aerodynamically prolongs another surface 43 in the aft direction, also used for outer delimitation of the annular fan flowpath 38, this surface 43 being defined by the outer ring of the fan frame 20.

Furthermore, FIG. 1 showing the turbojet 10 also includes an LPTACC or LPTCC system 2 for regulation of an airflow contributing to controlling the clearance at the tip in the low pressure turbine 16 and a scoop 3 located on the IFD part 36.

The scoop 3 is placed on the IFD part 36 at the same axial position as the LPTACC or LPTCC system 2, and it supplies the system 2 with cooling air from the annular fan flowpath 38.

In order to pass cooling air from the scoop 3 as far as the system 2, an interface has to be set up to connect the scoop 3 and the system 2. This interface must be designed to be as leak tight as possible, particularly so as to limit air leaks that might reduce the cooling efficiency and to be able to accommodate relative displacements between the scoop 3 and the system 2, particularly to absorb radial, axial and/or tangential displacements relative to each other.

PRESENTATION OF THE INVENTION

The purpose of the invention is to at least partially overcome the needs mentioned above and disadvantages with embodiments according to prior art.

Thus, according to one aspect of the invention, its purpose is an interface device between first and second turbomachine elements, particularly between a turbomachine low pressure turbine active or inactive clearance control (LPTACC or LPTCC) system and a scoop located on a part forming an envelope, the outside of which defines an inner delimitation surface of a turbomachine annular fan flowpath characterised in that it comprises:

- an annular air inlet structure comprising opposite first and second parts, designed to come into contact with first and second turbomachine elements respectively, the first part being configured to be in swivel contact with the first element, and
- an elastic return device that can be placed around the air inlet structure and that will come into contact with at least the first element of the turbomachine.

With the invention, relative displacements between two turbomachine elements can be compensated, particularly an LPTACC or LPTCC system and a scoop located on an IFD part of the turbomachine, connected to each other through an interface device according to the invention, while maintaining sufficient leak tightness between these elements thus limiting pressure losses. Furthermore, the interface device according to the invention may be easily installed and removed between the two elements of the turbomachine, thus in particular avoiding complex disassembly of the IFD part. Furthermore, the invention can be used to design an interface device between two turbomachine elements that comprises a limited number of parts and that has a relatively low mass.

The interface device according to the invention may also comprise one or several of the following characteristics taken in isolation or in any technically possible combination.

The interface device may be installed on the first turbomachine element before being connected to the second turbomachine element.

The air inlet structure may be in the form of an air inlet tube.

The elastic return device may be a spring and may preferably be in the form of a helical spring with several turns.

The elastic return device can also compensate relative displacements between the first and second turbomachine elements. In particular, it absorbs radial displacements between the two elements. Furthermore, the elastic return device provides a sufficient force to squeeze together contact zones between the air inlet structure and the second turbomachine element, and between the air inlet structure and the first turbomachine element.

The air inlet structure may comprise a fan flow seal ring for calibration of the airflow entering into the air inlet structure.

The fan flow seal ring may be in the form of a disk provided with a circular central orifice through which air can pass. The fan flow seal ring may be located at the second part of the air inlet structure. The fan flow seal ring may be removable relative to the air inlet structure or it may be fixed.

The fan flow seal ring can be used to calibrate the air inlet flow into the first turbomachine element in order to adjust it to a required value.

The device may also comprise an elastic ring located between the fan flow seal ring and the second part of the air inlet structure.

The elastic ring can be used to hold the fan flow seal ring in position in a recess formed on the air inlet structure. The elastic ring may provide sufficient leak tightness of the interface between the two turbomachine elements.

The second part of the air inlet structure may comprise a plane surface in order to provide a sliding contact with the second turbomachine element. The second turbomachine element itself may comprise a plane surface such that sliding contact is provided between two plane surfaces in contact with each other.

The first part of the air inlet structure may comprise a swivel annular portion, the outside of which will come into contact with an inner annular surface of the first turbomachine element.

Thus, the first part may comprise a swivel annular portion at one end and a plane surface at the other end.

The swivel annular portion of the first part also compensates for relative displacements between the two turbomachine elements. In particular, the swivel annular portion absorbs axial and tangential displacements between the two turbomachine elements.

Relative displacements between the two turbomachine elements, namely axial, radial and/or tangential displacements may be at most 3 mm.

A coating can be applied on one or several of the parts in contact, particularly parts of the device according to the invention, for example on the air inlet structure.

It may be possible to place the elastic return device around the air inlet structure bearing on an outer annular surface of the first turbomachine element, opposite the inner annular surface, such that at least part of the first turbomachine element comprising the inner and outer opposite surfaces is located between the elastic return device and the swivel annular portion of the air inlet structure.

According to another aspect of the invention, it applies to a turbomachine characterised in that it comprises an interface device like that defined above, located between the first and second turbomachine elements.

The first turbomachine element may preferably be an active or inactive system to control the clearance of the low pressure turbine of the turbomachine.

The second turbomachine element may preferably be a scoop located on a part forming an envelope, the outside of which defines an inner delimitation surface of an annular fan flowpath of the turbomachine.

Therefore, the invention can thus provide the turbomachine with an interface technology to allow air supply to the LPTACC or LPTCC system from a scoop located on the IFD part.

The air inlet structure may be force fitted onto the first turbomachine element or preferably may have a rocker fitting.

The first turbomachine element may comprise at least one means of retaining the air inlet structure configured to prevent the air inlet structure from separating from the first turbomachine element, particularly during assembly and/or disassembly of the device according to the invention relative to the first turbomachine element.

In particular, the first turbomachine element may comprise at least two air inlet structure retaining means for example distributed symmetrically on the first turbomachine element.

The retaining means may be in the form of retaining tabs, particularly in the form of a "lug", in other words comprising a thinned bottom portion widening outwards to form two opposite lobes. This form of the retaining means can be used to limit stresses during force fitting of the air inlet structure on the first turbomachine element.

The retaining means may comprise a projecting rib designed to cooperate with the air inlet structure, particularly with a swivel annular portion of the air inlet structure.

The sizing of the retaining means may be determined so as to enable an efficient support to the air inlet structure on the first turbomachine element and to authorise a rocker fitting of the air inlet structure on the first turbomachine element. Furthermore, the retaining means can be designed so as not to become plastic during operation of the turbomachine, and particularly so as not to become plastic in case of force fitting.

BRIEF DESCRIPTION OF THE DRAWINGS

The invention will be better understood after reading the detailed description given below of non-limitative examples of the invention, and after examining the diagrammatic and partial figures in the appended drawing in which.

In all these figures, identical references may refer to identical or similar elements.

Furthermore, the different parts shown in the figures are not necessarily all shown at the same scale to make the figures more easily readable.

DETAILED PRESENTATION OF PARTICULAR EMBODIMENTS

Figure 1:
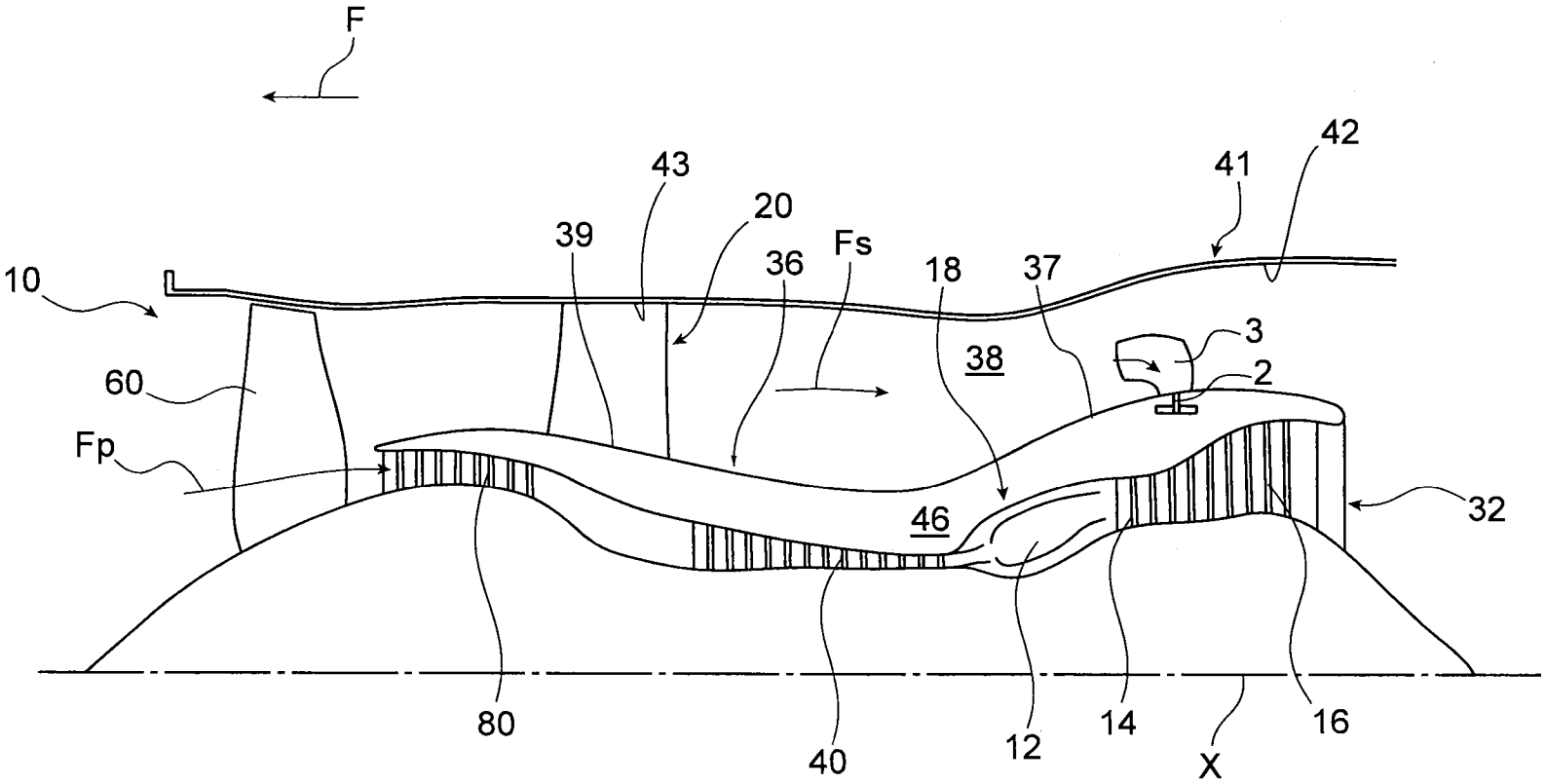
FIG. 1 diagrammatically shows a longitudinal half-section of a turbofan engine for an aircraft.

FIG. 1 has already been described.

Figure 2:
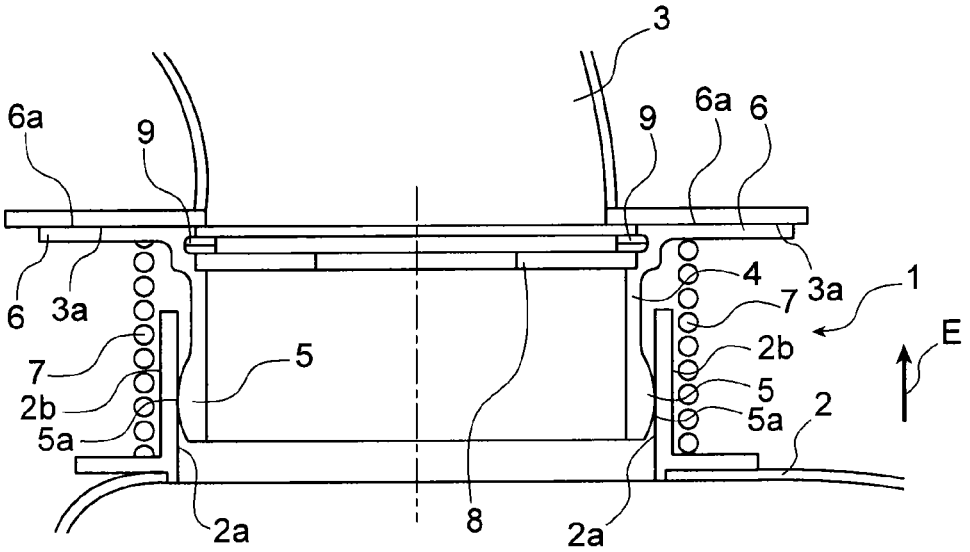
FIG. 2 shows a sectional view of an example of an interface device according to the invention placed between first and second turbomachine elements.
Figure 3:
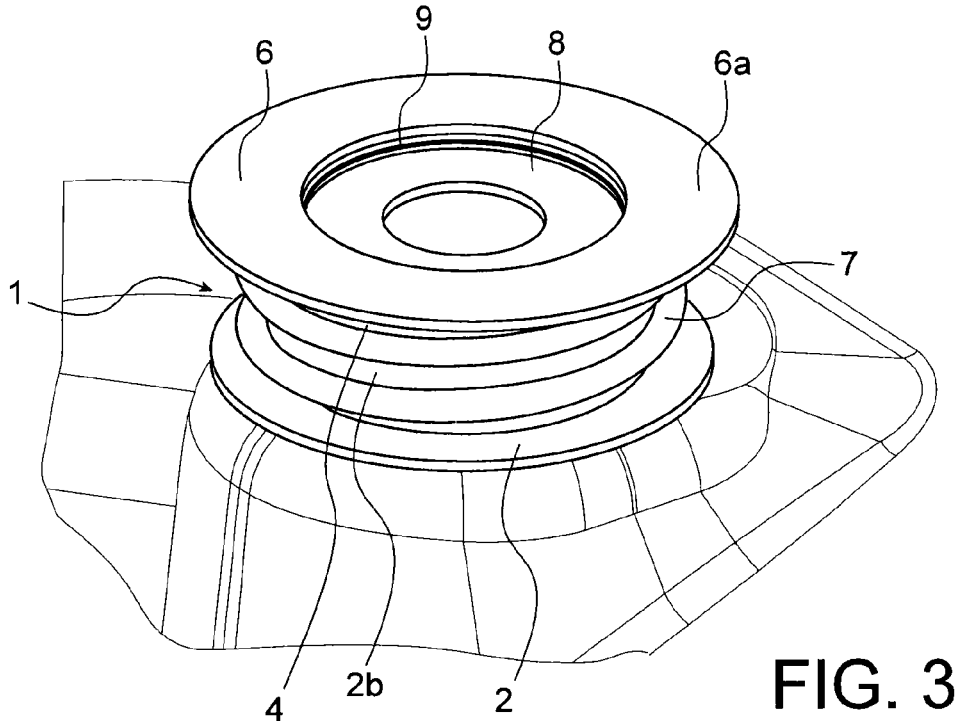
FIG. 3 shows a perspective view of the interface device and the first turbomachine element in FIG. 2.
Figure 4:
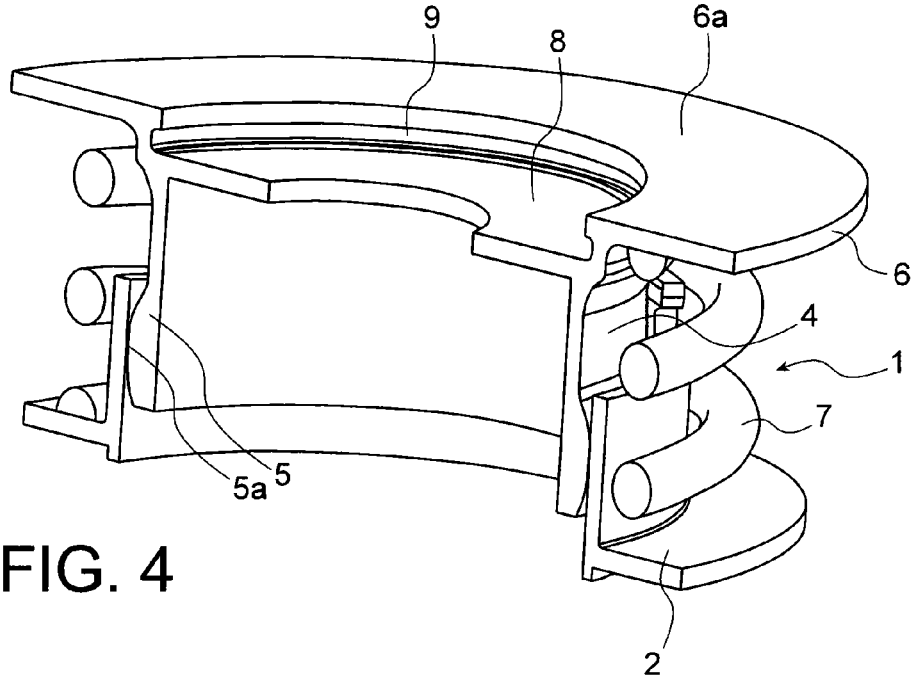
FIG. 4 shows a partial perspective sectional view of the interface device and the first turbomachine element in FIG. 3.

With reference to FIGS. 2 to 4, the figures show an example of an interface device 1 according to the invention that will be placed between a first turbomachine element 2 and a second turbomachine element 3.

More particularly and preferably, the first turbomachine element 2 is a low pressure turbine active or inactive clearance control system (LPTACC or LPTCC system) and the second turbomachine element 3 is a scoop located on a part forming an envelope, the outside of which defines an inner delimitation surface of an annular fan flowpath of the turbomachine (IFD part), as was disclosed above with reference to FIG. 1.

The interface device 1 comprises an annular air inlet structure 4 in the form of an inlet tube, which comprises a first part 5 and a second part 6 opposite each other, located in contact with the LPTACC or LPTCC system 2 and the turbomachine scoop 3.

Furthermore, the interface device 1 comprises an elastic return device 7 in the form of a helical spring with a plurality of turns that is placed around the inlet tube 4 and that comes into contact with the system 2.

The first part 5 of the inlet tube 4 comprises a swivel annular portion 5*a*, the outside surface of which comes into contact with an inner annular surface 2*a* of the turbomachine system 2. Thus, the first part 5 of the inlet tube 4 is in swivel contact with the system 2.

The presence of the helical spring 7 and the swivel annular portion 5*a* compensates for relative displacements between the different parts. In particular, the spring 7 can absorb radial displacements, while the swivel annular portion 5*a* absorbs axial and tangential displacements.

The spring 7 is placed around the inlet tube 4 bearing on an outer annular surface 2*b* of the turbomachine system 2 opposite the inner annular surface 2*a* such that at least part of the system 2 comprising opposite inner annular surface 2*a* and outer annular surface 2*b* is located between the spring 7 and the swivel annular portion 5*a* of the inlet tube 4.

Furthermore, as shown in FIG. 1, the helical spring 7 provides a sufficient force along the direction of the arrow E to force together the contact zone 3*a* of the scoop 3 and the contact zone 6*a* of the second part 6 of the inlet tube 4. These contact zones are formed by the plane surface 3*a* of the scoop 3 and the plane surface 6*a* of the second part 6 of the inlet tube 4, so as to obtain a sliding contact between the inlet tube 4 and the scoop 3.

The inlet tube 4 also comprises an airflow fan flow seal ring 8 to calibrate air entering the inlet tube. The fan flow seal ring 8 advantageously calibrates the input airflow into the system 2 to adjust it to the required value. It is preferably removable during the design phase until convergence about an optimum diameter.

Furthermore, particularly in order to make the interface device 1 leak tight and especially to hold the fan flow seal ring 8 in position in its housing, an elastic ring 9 is placed between the fan flow seal ring 8 and the second part 6 of the inlet tube 4.

The inlet tube 4 can preferably be installed on the system 2 with a rocker fitting, although force fitting is also possible.

Figure 5:
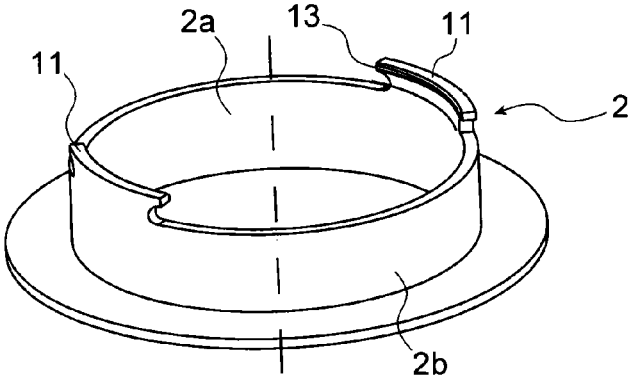
FIG. 5 shows a perspective view of an example of a first turbomachine element comprising retaining means for an air inlet structure of an interface device according to the invention.
Figure 6:
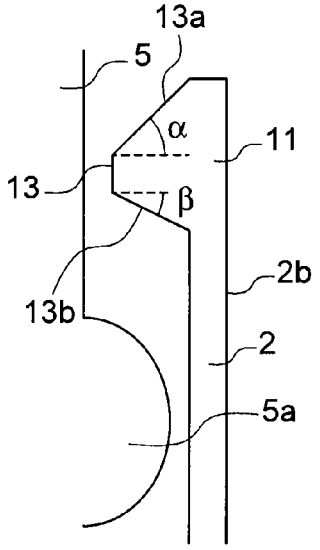
FIG. 6 shows cooperation between a retaining means of the first turbomachine element in FIG. 5 and an air inlet structure of an interface device according to the invention.

In order to make sure that it is impossible for the inlet tube 4 to separate from the system 2 during assembly and/or disassembly of the interface device 1 on the turbomachine, the system 2 may comprise means 11 of retaining the inlet tube 4 as shown in FIGS. 5 and 6.

As can be seen in FIG. 5, each retaining means 11 may form a tab in the form of a "lug" in other words comprising a thinned bottom portion that becomes wider towards the outside to form opposite lobes. This form can limit stresses during assembly of the inlet tube 4 on the system 2 by force fitting, if force fitting is applied.

As can also be seen in FIG. 6, each retaining means 11 comprises a projecting rib 13 that cooperates with the swivel annular part 5*a* of the inlet tube 4 so to prevent the inlet tube 4 from separating from the system 2.

The rib 13 may be formed on the retaining means 11 by adjacent or non-adjacent portions 13*a*, 13*b*, (as shown) forming angles $\alpha$, $\beta$ respectively with the normal of the outer annular surface 2*b*.

The size of the angles $\alpha$, $\beta$ may be determined so as to control operation of the interface device 1 according to the invention.

In particular, the angle $\alpha$ may be selected to minimise stresses in the case of force fitting of the inlet tube 4 on the system 2.

The angle $\beta$ may be selected to limit the radial force generated by the axial force of the spring 7, this force tending to "open" the retaining means 11, and thus to separate the inlet tube 4 from the system 2.

Obviously, the invention is not limited to the example embodiments described above. Those skilled in the art can make various modifications to it.

The term "comprising a" must be understood as being synonymous with "comprising at least one", unless mentioned otherwise.

The invention claimed is:

1. An interface device between first and second turbomachine elements, comprising:

an annular air inlet structure comprising opposite first and second parts, designed to come into contact with first and second turbomachine elements respectively, the first part being configured to be in swivel contact with the first element; and an elastic return device, that can be placed around the air inlet structure and that will come into contact with at least the first element of the turbomachine.

2. The device according to claim 1, wherein the air inlet structure comprises a fan flow seal ring for calibration of the airflow entering into the air inlet structure.

3. The device according to claim 2, further comprising an elastic ring located between the fan flow seal ring and the second part of the air inlet structure.

4. The device according to claim 1, wherein the second part of the air inlet structure comprises a plane surface in order to provide a sliding contact with the second turbomachine element.

5. The device according to claim 1, wherein the first part of the air inlet structure comprises a swivel annular portion, an outside of the swivel annular portion in contact with an inner annular surface of the first turbomachine element.

6. The device according to claim 5, wherein the elastic return device may be placed around the air inlet structure bearing on an outer annular surface of the first turbomachine element, opposite the inner annular surface of the first turbomachine element, such that at least part of the first turbomachine element comprising the inner and outer opposite annular surfaces is located between the elastic return device and the swivel annular portion of the air inlet structure.

7. A turbomachine comprising an interface device according to claim 1, located between first and second turbomachine elements.

8. The turbomachine according to claim 7, wherein the first turbomachine element is an active or inactive system (LPTACC or LPTCC) to control the clearance of the low pressure turbine of the turbomachine, and wherein the second turbomachine element is a scoop located on a part forming an envelope an outside of the part defines an inner delimitation surface of an annular fan flowpath of the turbomachine.

9. The turbomachine according to claim 7, wherein the first turbomachine element comprises at least one retaining means of the air inlet structure configured to prevent the air inlet structure from separating from the first turbomachine element.

10. The turbomachine according to claim 9, wherein said at least one retaining means comprises a projecting rib designed to cooperate with the air inlet structure.

11. An interface device between first and second turbomachine elements, comprising:

an annular air inlet structure comprising opposite first and second parts, designed to come into contact with first and second turbomachine elements respectively, the first part being configured to be in swivel contact with the first element; and an elastic return device, that can be placed around the air inlet structure and that will come into contact with at least the first element of the turbomachine, wherein the second part of the air inlet structure comprises a plane surface in order to provide a sliding contact with the second turbomachine element.

* * * * *